United States Patent [19]

Taylor

[11] Patent Number: 4,549,574

[45] Date of Patent: Oct. 29, 1985

[54] FLUIDIC DEVICES

[75] Inventor: Stephen A. Taylor, Preston, England

[73] Assignee: United Kingdom Atomic Energy Authority, London, England

[21] Appl. No.: 607,821

[22] Filed: May 7, 1984

[30] Foreign Application Priority Data

May 20, 1983 [GB] United Kingdom ..... 8314054

[51] Int. Cl.[4] ..... F15C 1/10

[52] U.S. Cl. ..... 137/565; 137/803; 137/833; 137/841

[58] Field of Search ..... 137/833, 841, 565, 803

[56] References Cited

U.S. PATENT DOCUMENTS

| | | | |
|---|---|---|---|
| 3,240,219 | 3/1966 | Dexter et al. | 137/841 |
| 3,492,920 | 2/1970 | Czajkowski et al. | 91/3 |
| 3,592,210 | 7/1971 | Steptoe et al. | 137/841 |
| 3,690,339 | 9/1972 | McKinnon et al. | 137/841 |

FOREIGN PATENT DOCUMENTS

| | | | |
|---|---|---|---|
| 1802757 | 10/1968 | Fed. Rep. of Germany | 137/841 |

*Primary Examiner*—A. Michael Chambers
*Attorney, Agent, or Firm*—William R. Hinds

[57] ABSTRACT

A fluidic diverter comprising a housing forming a chamber having an inlet at one end and two diverging outlets at the opposite end. An asymmetric configuration is produced within the chamber by axially spaced steps in opposing walls of the chamber and a single control port communicates with the chamber at a position associated with the step adjacent the inlet. In use and in the absence of a control at the control port, flow will emerge through the outlet at the side of the chamber associated with the control port. A fluidic pumping system includes a fluidic pump having the fluidic diverter in a delivery line of the pump.

4 Claims, 3 Drawing Figures

FLUIDIC DEVICES

The present invention concerns fluidic devices, in particular, fluidic diverters and fluidic pumping systems incorporating diverters.

BACKGROUND OF THE INVENTION

A fluidic diverter is a device for diverting an inlet flow through one of two outlets and relies on the Coanda effect by which flow attaches itself to a wall of the diverter until it is switched away from the wall by an externally applied control. In one existing form of diverter the direction of flow taken by the fluid is entirely random and the flow can attach itself to the wall merging with either of the two outlets. This is because the diverter construction is symmetrical about the axis of the inlet into the diverter and hence in the absence of control the flow has no preference for the outlets.

An asymmetric form of diverter is also known in which the side wall associated with one outlet is closer to the centre line than the side wall associated with the other outlet. In this arrangement the Coanda effect will result in the inlet flow following the first mentioned side wall to emerge at the outlet associated therewith. The inlet flow can be diverted to the other side wall and outlet by providing a pressure change at the first mentioned side wall immediately downstream of the inlet. This can be achieved by means of a control line in the side wall. The inlet flow is diverted to the other side wall to emerge at the associated outlet and remains in this state until removal of the control. On termination of the control the inlet returns to the first mentioned side wall.

In this known form of asymmetric diverter, the outlet for the flow is determined by the condition of the control line, that is whether the control line is open or closed. The diverter is monostable and flow will always emerge at the outlet associated with the first mentioned side wall in the absence or failure of the control.

The present invention aims to provide an asymmetric diverter having two stable flow states which are independent of the condition of the control.

FEATURES AND ASPECTS OF THE INVENTION

According to one aspect of the present invention a fluidic diverter comprises a housing forming a chamber having a fluid inlet at one end and diverging fluid outlets at its opposite end, the walls of the chamber merging smoothly with the walls of the outlets characterised by a first step in one wall of the chamber at the junction with the inlet, a second step in the opposing wall of the chamber at a position staggered axially with respect to the first step to provide an asymmetric configuration to the chamber and a control port communicating with the chamber at a position associated with the first step.

According to a further aspect of the invention a fluidic pumping system comprises an intermittently operable fluidic pump having a diverter as hereinbefore defined in a delivery line of the pump for directing fluid delivered by the pump along a required flow path.

DESCRIPTION OF THE DRAWINGS

The invention will be described further, by way of example, with reference to the accompanying drawings; in which.

Figure 1:
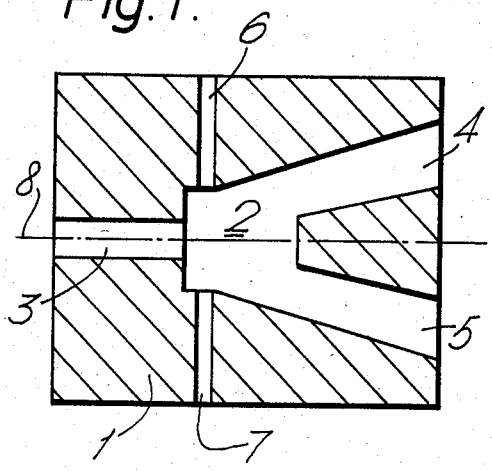
FIG. 1 is a diagrammatic sectional view of a prior art fluidic diverter.

A known form of fluidic diverter as shown in FIG. 1 comprises a housing 1 defining a chamber 2 having an inlet 3 at one end and a pair of diverging outlets 4, 5 at its opposite end. The walls of the chamber merge smoothly with the walls of the outlets. Control ports 6, 7 open into the chamber at opposing positions adjacent the inlet. The configuration and geometry of the prior art fluidic diverter is symmetrical about the axis of the inlet 3 as indicated by the dotted line 8.

In operation, a fluid entering the chamber through the inlet 3 is directed along one or other of the outlet ports 4, 5 by the application of a control flow to an appropriate one of the control ports 6, 7. Thus to direct flow along the outlet 4 a control flow is applied to the control port 7 and likewise for a flow along outlet 5 a control flow is applied to the control port 6. However in the absence of a control flow at the ports 6, 7 the operation of the diverter is entirely random on account of its symmetrical configuration. In other words with no control flow present at the ports 6, 7 the fluid flow entering the chamber through the inlet 3 has no preference for its outlet and is just as likely to emerge along the outlet 4 as along the outlet 5. This can be a disadvantage especially in situations where the diverter is located in inaccessible positions such as behind biological shielding in nuclear plant installations.

DESCRIPTION OF THE PREFERRED EMBODIMENT

Figure 2:
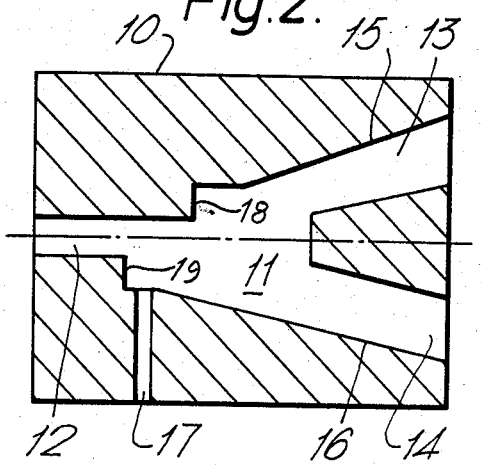
FIG. 2 is a diagrammatic sectional view of a fluidic diverter according to the invention.

Turning to FIG. 2, which illustrates an embodiment of a fluidic diverter according to the invention, a housing 10 forms a chamber 11 having an inlet 12 at one end and two diverging outlets 13, 14 at the opposite end. The walls of the chamber merge smoothly with the walls of the outlets. In contrast to FIG. 1 an asymmetric configuration is produced at the inlet end of the chamber by staggering steps, 18, 19 formed at the junction of the inlet with the walls 15, 16 of the chamber and by providing a single control port 17 in the wall 16 associated with the step 19. The step 18 associated with the wall 15 is located beyond the control port 17 into the chamber.

In operation, when fluid issues from the inlet into the chamber the steps create regions of reduced pressure which divert the flow to a side of the chamber. When the steps are symmetrical as in FIG. 1 there is an equal chance in the absence of any applied control flow, that the fluid will be diverted to outlet 4 or 5. When the steps are staggered, as in FIG. 2, and in the absence of any applied control flow, the fluid flow from the inlet will always be biased towards the wall 16 associated with the first step 19 that the fluid encounters on issuing from the inlet, to emerge at the outlet 14. On applying a control flow at the port 17, fluid entering the chamber will proceed to the second step before being diverted to the wall 15 and the flow, once established, will continue along the wall 15 to the outlet 13 and the control flow can then be discontinued.

Figure 3:
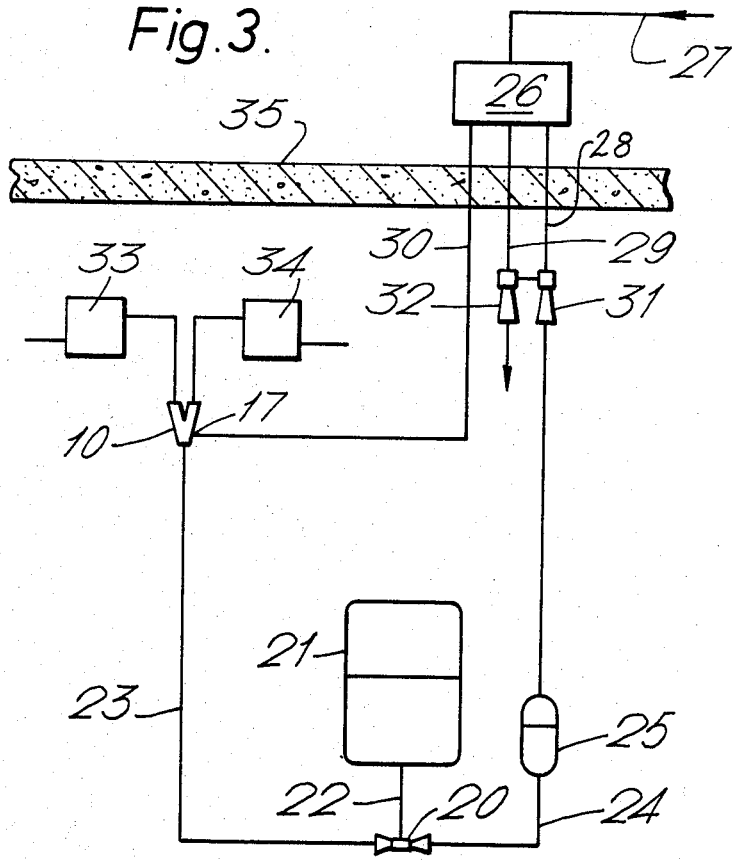
FIG. 3 is a diagrammatic fluidic pumping system incorporating a fluidic diverter according to FIG. 2.

The diverter can be installed in the delivery line of an intermittent pump and as shown in FIG. 3. The pump includes a fluidic device known as a reverse flow diverter RFD indicated by reference numeral 20. Briefly the RFD comprises two nozzles which are opposed to each other with a separation gap therebetween which communicates with a liquid which is to be pumped. In FIG. 3 the liquid to be pumped is contained in a tank 21 and flows to the gap between the nozzles of the RFD along a conduit 22. In practice it is convenient to locate the RFD within the liquid in the tank. One end of the RFD is connected to a delivery pipe 23 which leads to the inlet of the diverter. The opposite end of the RFD is connected by a pipe 24 to a charge vessel 25 which is subjected alternately to pressure and venting by means of a controller 26.

The controller 26 is coupled to a compressed air line 27. Branch air lines 28, 29 and 30 from the controller 26, each including a solenoid valve, lead respectively to a drive jet pump 31, a suction jet pump 32 and the control port 17 of the diverter. Pressure regulators can also be included in the lines from the controller.

On a pressure stroke, liquid is driven across the gap in the RFD to the delivery pipe 23 and through the diverter to one or other of delivery vessels 33, 34. The narrowing of the flow passage at the nozzles of the RFD causes a pressure drop to entrain liquid from the tank 21 into the delivery pipe. At the end of the pressure stroke and during venting liquid runs back along the delivery pipe and into the charge vessel 25. As the double nozzle RFD is symmetrical liquid from the tank is again entrained from the tank and carried into the charge vessel from which it is driven to the delivery pipe and one of the delivery vessels on the next pressure stroke. The pump is thus intermittent and delivers liquid on the pressure stroke applied to the charge vessel.

With the control port 17 to the diverter closed, or open to the atmosphere, that is with no control flow in the branch 30, the liquid delivered along the pipe 23 will always emerge from the outlet 14 of the diverter to pass into the delivery vessel 34. This state of operation will continue so long as no control flow is applied to the port 17. However if a control flow is applied at the commencement of a pressure stroke of the RFD the liquid entering the diverter will be directed to emerge at the outlet 13 and into the delivery vessel 33. When the liquid flow through the diverter is established, typically this can be after approximately 5 seconds, the control flow can be discontinued. The flow through the diverter will however continue to flow into the vessel 33. Thus in this mode of operation the liquid pumped during a pressure stroke will be delivered to one of the two vessels 33 and 34. The choice of vessels is determined by the control flow. In the absence of control flow the liquid is always delivered to the vessel 34. When a control flow is applied to the control port on commencement of a pressure stroke the liquid is delivered to the vessel 33. Control flow is required only when directing liquid into the delivery vessel 33. No control flow is required when liquid is to be directed into the vessel 34. This is of immediate practical advantage in an intermittent pumping system which is installed behind the shielding 35 as is the case in the nuclear industry where it is required to pump active liquids. In the event of a failure of the control flow an operator will know that the liquid can only be delivered into the vessel 34. In contrast, with a diverter of the kind described with reference to FIG. 1, in such a situation the operator will not know, without additional indicating means, which delivery vessel is receiving liquid due to the random nature of the diverter.

The control can be arranged such that when it is desired to direct liquid into the vessel 34 the solenoid valve in the line 30 to the control port remains closed or open to the atmosphere throughout the cycle of operation. When liquid is to be delivered to the vessel 33 the solenoid valve is arranged to apply a control flow at the commencement of the pressure stroke and remains open for a preset period (about 5 seconds) determined by a timer.

Instead of applying a positive pressure pulse to the control port 17 it is possible to achieve the same effect by applying a negative pressure pulse to a port in the wall at the opposite side of the inlet.

I claim:

1. A fluidic diverter comprising a housing, a chamber within the housing, a fluid inlet at one end of the chamber, diverging fluid outlets at the opposite end of the chamber, the walls of the chamber merging smoothly with the walls of the outlet, a first step in one wall of the chamber at its junction with the inlet, a second substantially identical and oppositely directed step in the opposing wall of the chamber at a position staggered axially with respect to the first step to provide an asymmetric configuration at the inlet end of the chamber and a control port communicating with the chamber at a position associated with the first step.

2. A fluidic pumping system comprising an intermittently operable fluidic pump with a fluidic diverter according to claim 1 in a delivery line of the pump for directing fluid delivered by the pump along a required flow path.

3. A fluidic diverter comprising a housing, a chamber within the housing, a fluid inlet at one end of the chamber, diverging fluid outlets at the opposite end of the chamber, the walls of the chamber merging smoothly with the walls of the outlets, means comprising a first step in a first wall of the chamber at its junction with the inlet for causing initial and subsequent incoming fluid from the inlet to be normally biased toward said first wall to emerge at a first one of the outlets until biased by a fluid signal and diverted to a second one of the outlets, means comprising a second substantially similar and oppositely directed step in a second opposing wall of the chamber at a position staggered axially with respect to the first step for causing initial and subsequent incoming fluid from the inlet to be biased toward said second opposing wall and to continue to emerge from said second of said outlets once it has been biased by a fluid signal and diverted to said second outlet, regardless of the continuance or discontinuance of the fluid signal, and a control port communicating with the chamber at a position associated with said first step for selectively effecting a temporary fluid signal when flow through said second outlet is desired, the construction and arrangement being such that initial and continuing flow will always be through said first outlet until diverted by a fluid signal to said second outlet, and flow thereafter will be through said second outlet until there is an interruption of the flow, regardless of the discontinuance of the fluid signal, and resumed flow after an interruption will be through said first outlet until diverted by a fluid signal.

4. A fluidic pumping system comprising an intermittently operable fluidic pump with a fluidic diverter as claimed in claim 3 in a delivery line of the pump for directing fluid delivered by the pump along a required flow path, such that each intermittent flow from the pump will pass through said first outlet unless diverted to said second outlet by a fluid signal, and each intermittent flow diverted by a fluid signal will continue through said second outlet for its duration, regardless of termination of the fluid signal during the duration of such a diverted intermittent flow.

* * * * *